US007080751B2

(12) United States Patent
Grazziotin

(10) Patent No.: US 7,080,751 B2
(45) Date of Patent: Jul. 25, 2006

(54) REMOVABLE LINER COUPLED TO A RECEPTACLE FOR COLLECTION OF DEBRIS

(76) Inventor: Fernando Alberto Grazziotin, Rua Francisco Alvea, 398 Vila Rodrigues, Passo Fundo-RS (BR) 99070130

( * ) Notice: Subject to any disclaimer, the term of this patent is extended or adjusted under 35 U.S.C. 154(b) by 431 days.

(21) Appl. No.: 10/387,415

(22) Filed: Mar. 14, 2003

(65) Prior Publication Data

US 2003/0141303 A1 Jul. 31, 2003

Related U.S. Application Data

(63) Continuation-in-part of application No. 09/700,714, filed on Nov. 27, 2000, now abandoned.

(30) Foreign Application Priority Data

May 28, 1998 (BR) ..... 9801250

(51) Int. Cl.
*B65D 6/40* (2006.01)

(52) U.S. Cl. ..... 220/661

(58) Field of Classification Search ..... None
See application file for complete search history.

(56) References Cited

U.S. PATENT DOCUMENTS 4,635,814 A * 1/1987 Jones ..... 220/495.05
4,712,711 A * 12/1987 Geering et al. ..... 220/254.2
6,318,581 B1 * 11/2001 Garton ..... 220/565

FOREIGN PATENT DOCUMENTS

EP 1097275 B1 12/1999

* cited by examiner

*Primary Examiner*—Stephen Castellano
(74) *Attorney, Agent, or Firm*—Jacobson Holman PLLC

(57) ABSTRACT

A complete cleaning of a container is achieved by the use of a removable polyethylene liner which removes all debris and avoids contact of the debris with the container at all times. Therefore cleanup of the container is quick, easy and simple. The liner is preformed to allow for a perfect lining of the entire container. The removable liner has the possibility of accommodating multiple openings for connection with one or more inlet pipes and one or more outlet pipes. The liner includes a series of prefabricated portions which may be weakened and removable to selectively accommodate multiple inlets and/or outlets. Only the desired position of a desired inlet or outlet is removed from the liner to accommodate a friction fit with an exterior surface of the inlet or outlet pipe to the container. Alternatively, a compressive force is exerted on the liner between a pipe and a coupling portion to hold the liner in place.

13 Claims, 7 Drawing Sheets

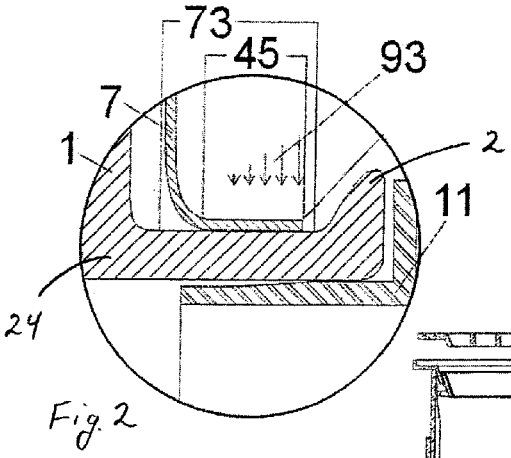
Fig. 2
Fig. 1
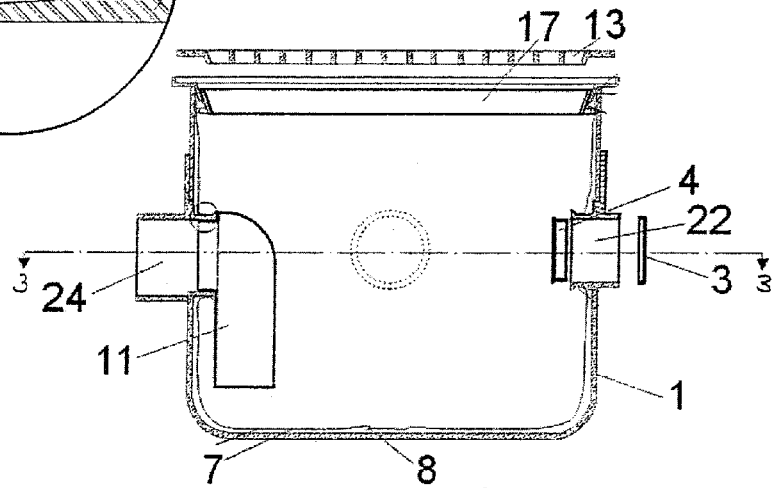
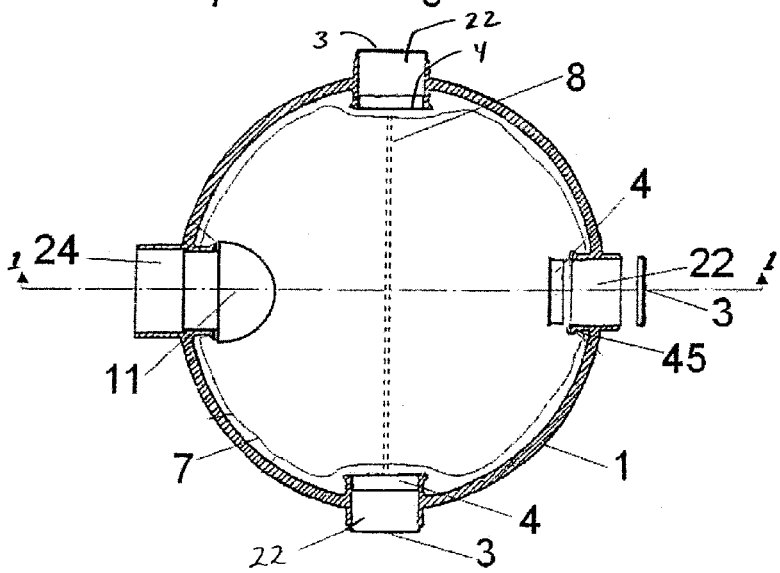
Fig. 3

Fig. 6
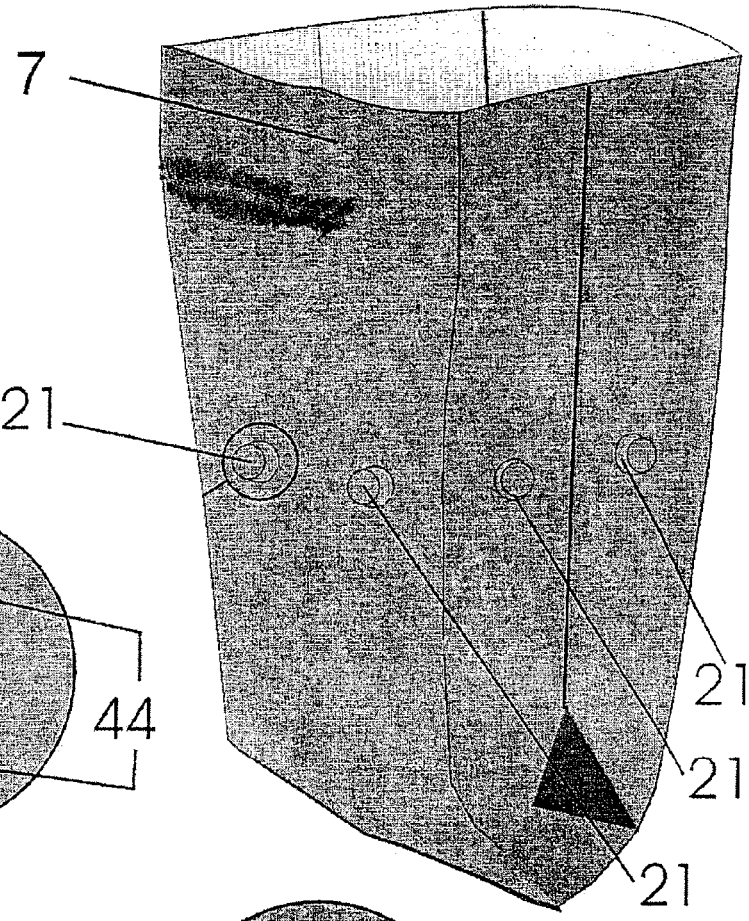
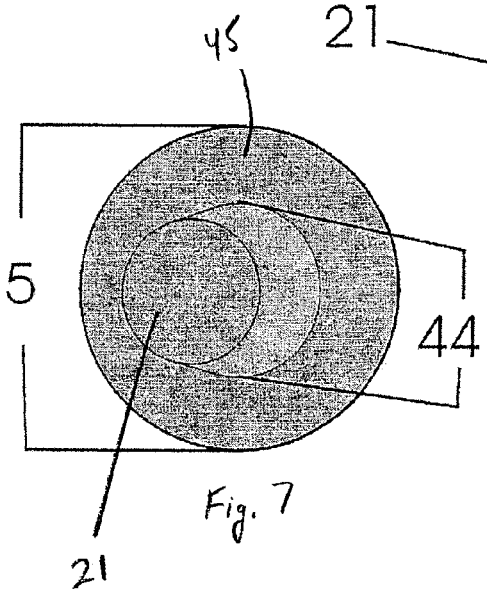
Fig. 7
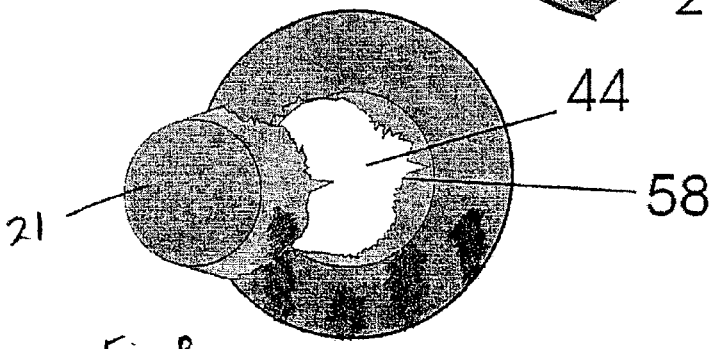
Fig. 8

25
25
25
25
25
25
25
23
7
5
44

47
25
23
45
19
19
19
8

62
44
45

Fig. 14
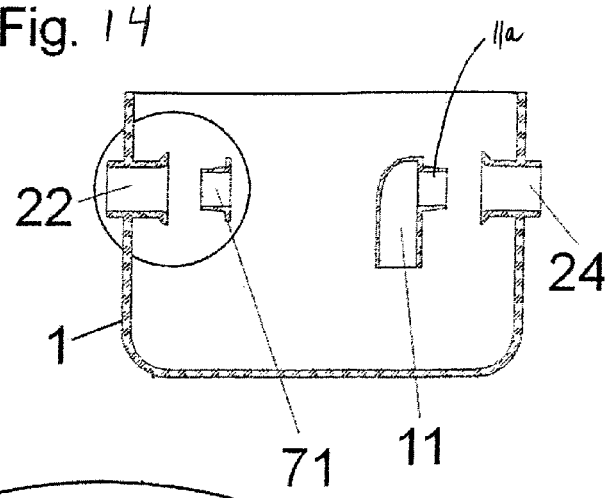
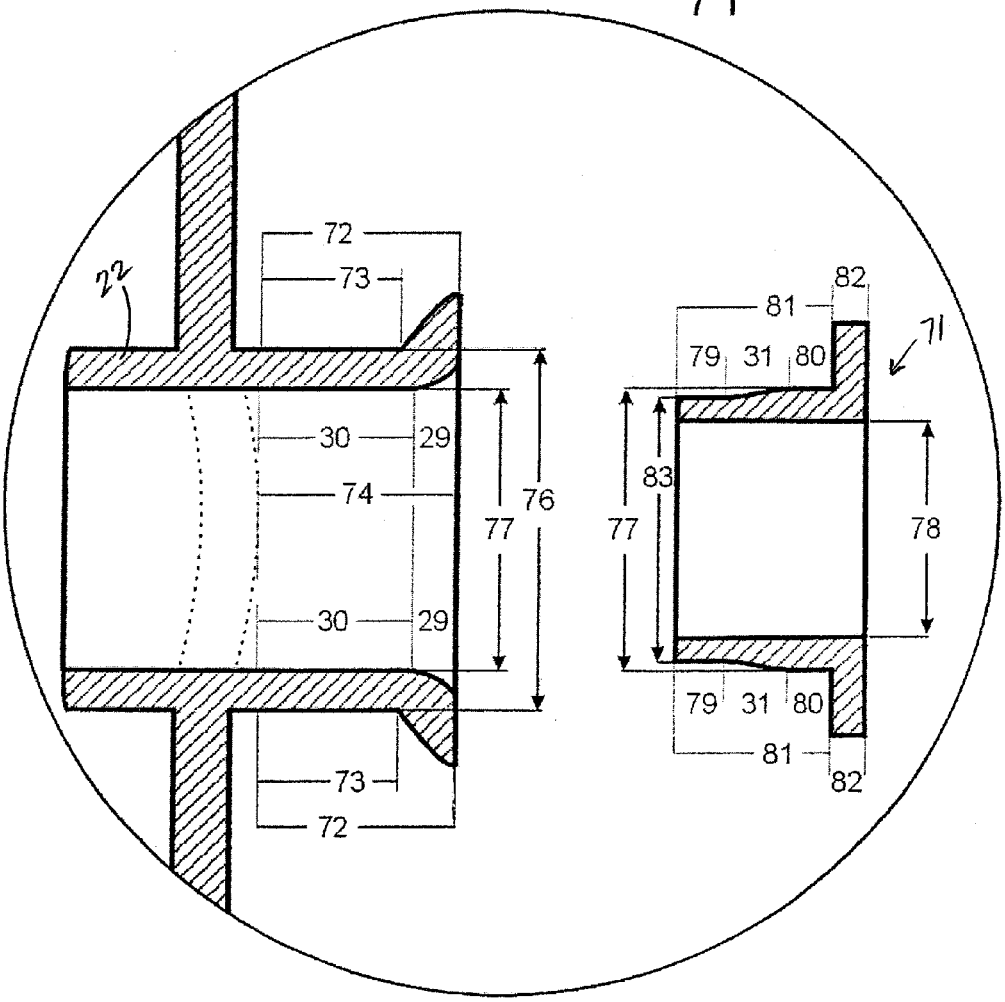
Fig. 15

Fig. 16
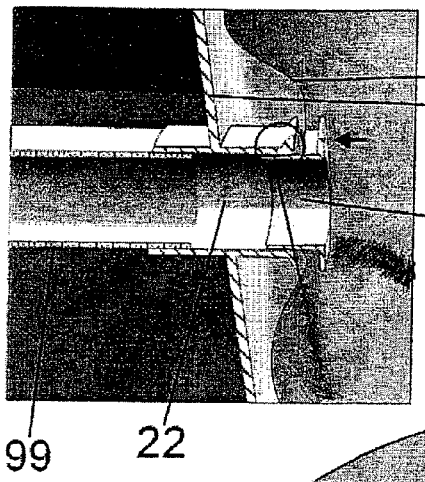
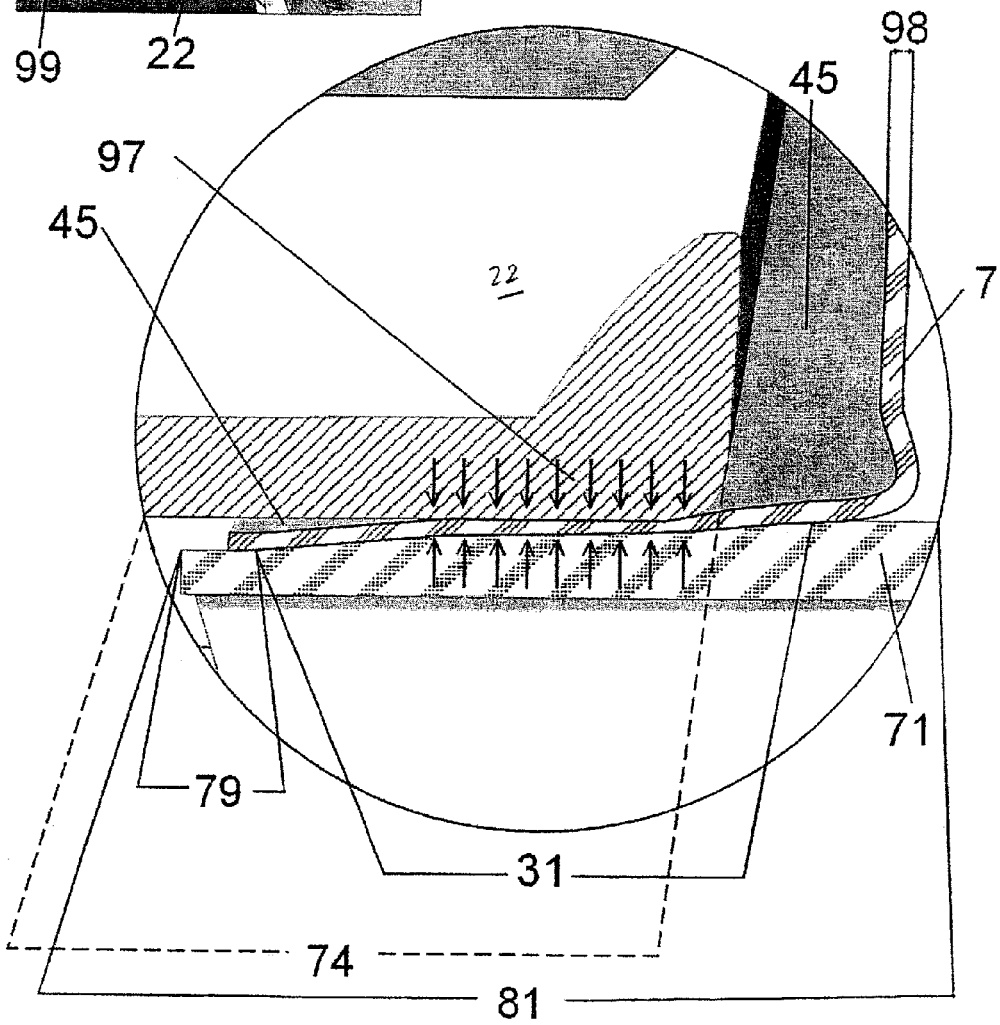
Fig. 17

REMOVABLE LINER COUPLED TO A RECEPTACLE FOR COLLECTION OF DEBRIS

This application is a continuation-in-part of application Ser. No. 09/700,714, filed Nov. 27, 2000, now abandoned, hereby incorporated in its entirety by reference.

FIELD OF THE INVENTION

The present invention relates to an assembly composed of a container connected to a water wasteline and having a removable liner. The waste products from the water wasteline travel through a pipeline into the container. The waste products are retained in the container due to their different density from the water passing through the container. The capture of the waste products minimizes the burden of waste products flowing to a waste removal system. Also, due to the sealing of the container unpleasant smelling gases are minimized and prevented from passing through the waste water system.

BACKGROUND OF THE INVENTION

Present grease trap systems receive waste water from an outlet pipe and retain heavier particles due to settling and lighter particles by flotation. The grease portion contained in the water floats on the surface of the water and is retained in the trap. Retention of the waste particles other than water minimizes the chances of clogging of the pipelines of a waste water removal system.

Most systems make use of a removable trap which once filled is disconnected from the inlet and outlet pipes and is entirely removed. The removed trap is either replaced with a new trap or the old trap is removed, cleaned and replaced in its original position.

Other waste water systems fail to include a trap and are therefore subject to the presence of foul smelling gases. These devices retain elements that are lighter than water and only retain particles denser than water through settling, time permitting.

With use in combination with sinks or toilets for example, traps are sometimes installed by bending of a pipeline of an outlet. These type traps prevent passage of gases but, however, require extensive maintenance for removal of particles denser than water.

In addition, commercial products are sold which are capable of partially dissolving grease and other waste products, for example. These commercial products are poured down a drain with the expectation of removal of particles denser than water. However, the requirement for complete removal of particles denser than water is only postponed due to the only partial removal of denser than water particles from the drainage system. Over time these particles build up and will eventually clog a drain.

Therefore, it appears that in all prior known embodiments, the cleaning of some type of trap for particles denser than water or those that float on water can only be postponed. Eventually, cleaning of the container trapping particles having a different density than water must ultimately be performed.

This task being distasteful to home owners must ultimately be carried out by professionals. Even for professionals, the task of cleaning the trapping container is difficult and takes considerable time. The removal of liquids or particles having a density different than water requires the operator to wear gloves and the use of various tools. If the level of liquid is low, even the use of tools makes such a task unpleasant and difficult.

In environments where sand is present, such as at the beach, the cleaning of the traps is not only difficult, but required to be performed quite often due to the accumulating presence of sand. Over time, these systems also fail.

Attempts have been made to use removable screens and/or receptacles placed in the containers. These alternatives only facilitate removal of part of the particles having a different density from water. They do not solve the problem of requiring a complete cleaning of the entrapping container.

SUMMARY OF THE INVENTION

The object of the present invention is to clean a container which traps particles having a density different from water without directly contacting these particles. The distasteful aspect of this task is minimized by the present invention so as to promote a more frequent maintenance of the container to avoid decomposition of the particles having a different density from water and avoids formation of unpleasant smelling gases.

A complete cleaning of a container is achieved by the use of a removable liner which removes all debris and avoids contact of the debris with the container at all times. Therefore cleanup of the container is quick, easy and simple.

The liner may be made of polyethylene, a polymeric material, rubber on plastic. The liner has sufficient elasticity, flexibility and malleability to allow accommodation of an internal shape of the container while being water tight and fitting around the outlet and inlet.

The liner is preformed to allow for a perfect lining of the entire container. The removable liner has the possibility of accommodating multiple openings for connection with one or more inlet pipes and one or more outlet pipes. The liner includes a series of prefabricated portions which may be weakened and removable to selectively accommodate multiple inlets and/or outlets. Only the desired position of a desired inlet or outlet is removed from the liner to accommodate a friction fit with an exterior surface of the inlet or outlet pipe to the container. Alternatively, a compressive force is exerted on the liner between a pipe and a coupling portion to hold the liner in place.

In one embodiment, the thickness of the wall of the liner is reduced at the potential points of removal of material. This will selectively accommodate the positioning of inlet and/or outlet pipes.

Movable caps may be used to seal unnecessary inlet or outlet pipes so as to protect against damage to the liner or dirtying of the surrounding container. If a particular inlet and/or outlet pipe is desired to be used, the movable cap may be removed and appropriate removable of material from the liner my be performed to accommodate a newly used inlet and/or outlet pipe.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 1 is a cross-sectional view of a container lined with the liner of the present invention and having an outlet shown and a capped inlet pipe.

FIG. 2 is an enlarged diagram of the area encircled in FIG. 1.

FIG. 3 is a cross-sectional view taken along line 3—3 of FIG. 1 and including a section line 1—1 representative of the cross-sectional line taken for FIG. 1.

FIG. 6 illustrates a liner having a plurality of designated areas for locating an inlet or outlet pipe by removal of a projection from the designated areas.

FIG. 7 is an enlarged view of a designated area having a projection.

FIG. 8 illustrates the removal of the projection so as to position an inlet or outlet pipe through the liner.

FIG. 14 is a cross-sectional view of a container having an inlet pipe and an outlet pipe with the inlet pipe and the outlet pipe being friction fit with a coupling piece for retaining therebetween at least one layer of a removable liner.

FIG. 15 shows an enlarged view of an area encircled in FIG. 14 and the details of the coupling piece used to secure a liner to the inlet pipe, for example.

FIG. 16 is a perspective cross-sectional view illustrating the friction fit of the liner between the coupling piece and the inlet pipe, for example.

FIG. 17 shows a further enlarged view of the compressive forces used to hold a liner between the coupling piece and the inlet pipe to seal the liner in place.

DETAILED DESCRIPTION OF THE PREFERRED EMBODIMENTS

Figure 5:
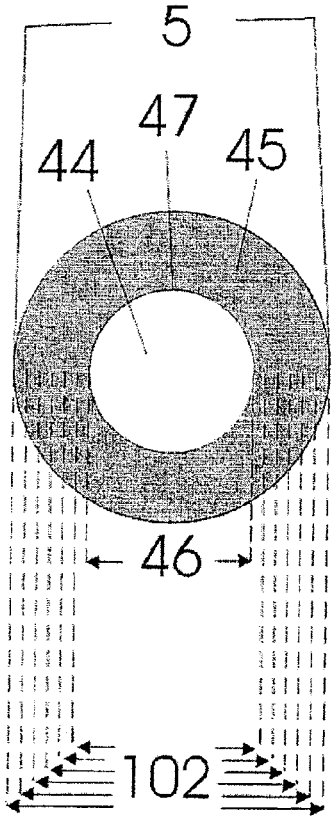
FIG. 5 is an enlarged view of the perforated area of the liner.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to FIGS. 1 through 3, in particular, a container 1 is shown having an inlet pipe 22 and an outlet pipe 24. Placed into the container 1 is a liner 7 which is expandable due to folding to conform to the interior surface of the container. The liner has a bottom seal 8 and a plurality of spaced apart areas, including preformed faults in the polyethylene material of the liner, pre-weakened portions or other mechanisms for facilitating production of holes in the liner. These areas are formed to accommodate varying numbers of inlets and outlets to the container 1 so as to be universally acceptable to various containers while locating an opening close to a potential inlet or outlet pipe.

When the liner is placed in the container, as shown in FIG. 1, an opening in the liner, as shown in an enlarged view in FIG. 2, snugly fits around an outer surface 73 of the outlet pipe 24, for example. The peripheral portion 45 of the open portion of the liner is stretched to fit over a protrusion 2 of the outlet pipe and hold tightly against surface 73 under a bias force 93 holding the portion 45 onto close contact with the outlet pipe 24.

As shown in FIG. 3, various inlet pipes 22 to the container 1 are formed. However, it this example, only one inlet pipe is to be used. The other two inlets being covered by an internal cap 4 and an external cap 3. In the inlet pipe which will be used to feed waste water into the container, the internal cap 4 or external cap 3 are removed and an opening formed in the liner is forced around the inlet pipe 22 in the same way as was done with outlet pipe 24.

To facilitate the movement of waste water through the container, a trap pipe 11 is inserted into the outlet pipe 24 so that only waste water is allowed to exit from the container. Particles denser and lighter than water are retained in the container. The upper open end of the liner is sealed to the top of the container by a lid 17 secured in place by a grid 13.

After a predetermined period of use, and after removal of most of the water from the container, the lid 17 is removed and the liner is carefully removed. All waste particles are thereby removed, leaving a clean container. A new liner may thereafter be placed and secured in the container.

Figure 4:
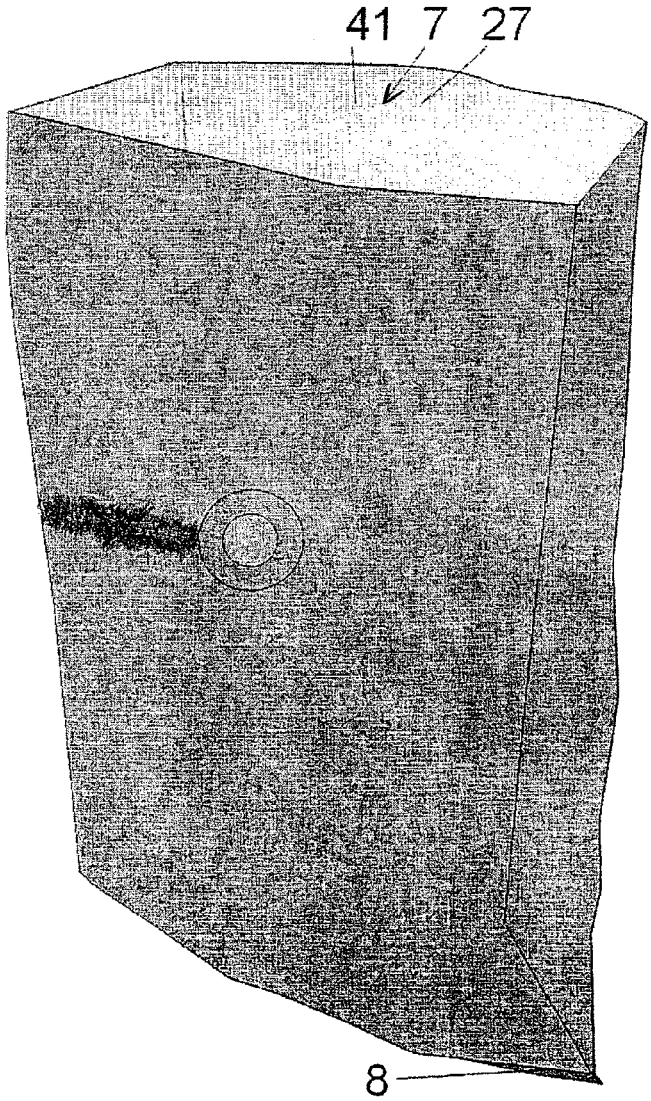
FIG. 4 is a perspective view of a single layer liner of the present invention having a perforated area for introducing an inlet or outlet pipe into the liner.

In FIGS. 4 and 5, a liner 7 is shown forming a bag 41 made up of polyethylene film 27. In FIG. 4, a single area for potentially inserting an inlet pipe or outlet pipe is shown as including two concentric circles. It is understood as being within the scope of the present invention that multiple such areas may be formed on the bag 41.

As shown in FIG. 5, on an enlarged scale, the area 5 formed by two concentric circles may be formed of a reinforced section 45 terminating in circular perforations or performed line of weakness 47 having a diameter 46. Upon punching of the perforations or cutting the line of weakness 47, the hole 44 is formed. It is envisioned as being within the scope of the present invention that the hole 44 could have various diameters 102 as illustrated in dotted lines to accommodate different diameter pipes.

Alternatively, as shown in FIGS. 6 through 8, a liner 7 may include a plurality of projections 21 which are shown in an enlarged view in FIG. 7. Each area 5 includes a reinforced section 45 with a radially inwardly spaced truncated conical portion 21. As shown in FIG. 8 by cutting along line 58, the truncated conical portion 21 is removed leaving a hole 44 for insertion of an inlet pipe or an outlet pipe through the liner 7.

Figures 9, 10, 11, 12:
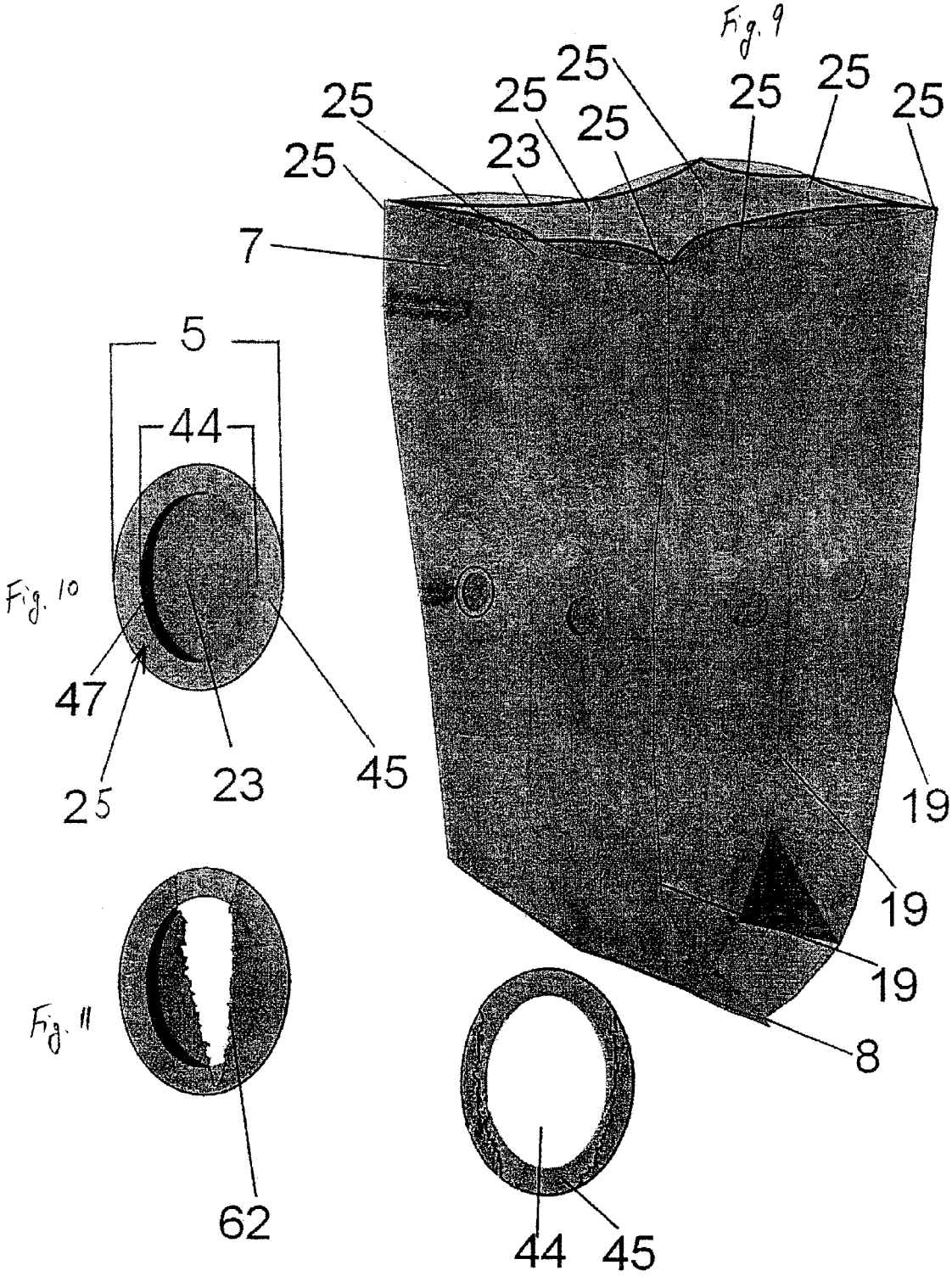
FIG. 9 is a perspective view of a two layer liner having numerous potential opening sites for an inlet and outlet pipe.
FIG. 10 is an enlarged view of a potential area for passage therethrough of an inlet or outlet pipe.
FIG. 11 shows a partial opening in a designated opening of the liner for positioning of an inlet or outlet pipe.
FIG. 12 shows removal of one layer of the liner for positioning therethrough of an inlet or outlet pipe.

In an alternative embodiment, as shown in FIGS. 9 through 12, the liner 7 is formed of an outer film layer 25 secured along edges or folds 19 to an internal, thinner film layer 23. As shown in FIG. 10 on an enlarged scale, a designated area 5 having a precut hole 44 in outer film layer 25 includes a reinforced section 45 exposing through the hole 44 a portion of the inner thin film layer 23. Perforations or line of weakness 47 in inner film layer 23 facilitates the breaking open of a long ripped edge 62 as shown in FIG. 11, allowing entryway into the interior of the liner through the hole 44, now also passing through inner thin film layer 23.

Figure 13:
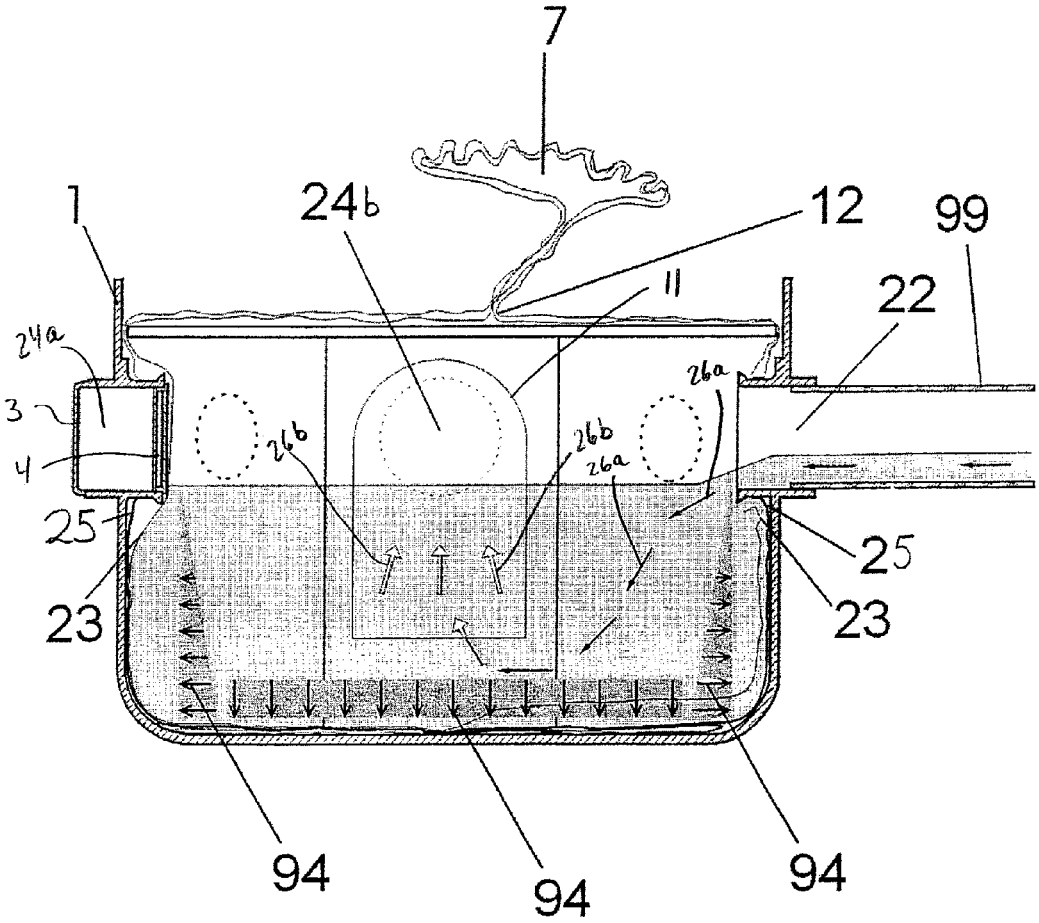
FIG. 13 is a cross-sectional view of an alternate arrangement of the present invention using a two layer liner.

As shown in FIG. 13, the double layer liner 7 is positioned in a container 1 such that an inlet 22 connected to pipe-line 99 passes through both layers 23, 25 of the liner. In this example, outlet 24*a* has an interior cap 4 and an exterior cap 3 with the outlet 24*a* passing through the preformed opening of the outer film layer 25 and the thin inner film layer 23 blocking passage of water or other particles to the outlet 24*a* which in the example of FIG. 13 is not used. In this example, outlet 24*b* is used to withdrawal water which flows in the direction of arrows 26*a* in an initial downward movement and then up along the direction of arrows 26*b* after passing into trap pipe 11. Arrows 94 are representative of the settling of particles denser than water to settle at the bottom of the container 1.

An alternate arrangement of securing the liner to the inlet pipe 22 and outlet pipe 24 is shown in FIGS. 14 through 17. In this embodiment, as shown in FIG. 14, trap pipe 11 has a projection 11*a* which fits into the interior of the outlet pipe 24. Similarly, a coupling piece 71 projects into the interior of inlet pipe 22 to secure the liner therebetween. The compression of the liner between two pieces is accomplished by a specific arrangement of the relative dimensioning of the coupling piece 71 and projection 11*a* of trap pipe 11 with respect to the inlet and outlet pipes as is shown on an enlarged skill in FIG. 15. In this Figure, the interior diameter 78 of coupling piece 71 is of a constant dimension. However, the exterior surface 81 terminating at end 82 proceeds through a progression of lessening exterior diameters. Initially portion 80 includes a diameter 77 which gradually lessens along tapered portion 31 to a constant diameter 83 of final section 79. This same arrangement of dimensioning is also formed by projection 11*a* of trap pipe 11.

To accommodate the insertion of coupling piece 71 into the interior diameter 77 of inlet pipe 22 at segment 74, the inlet pipe 22 includes a section 72 having exterior portion 73 and internal portion 30 having constant diameters 76, 77, respectively. At a leading interior portion 29, a tapered opening is formed to help guide entryway of the coupling piece 71. Interior diameter 77 of pipe 22 is equal to the exterior diameter 77 of portion 80 of the coupling device 71.

As shown in an assembled condition in FIG. 16, the liner 7 is held between the interior of inlet pipe 22 and the exterior of coupling piece 71. This allows water to pass into the liner 7 from pipe-line 99.

As shown in greater detail in FIG. 17, liner 7 is wedged between the coupling device 71 and the inlet pipe 22 primarily along the tapered portion 31 of the exterior surface of the coupling device piece 71. The forces of compression are illustrated by arrows 97 in between the portions 45 of the liner which are located on opposite sides of the compression arrows area 97. Portions 45 of line 7 are shown in shaded portions, indicative of circumferentially receding portions of liner 7 as are also shown in FIG. 16.

Due to the compressive forces on the liner 7, a tight coupling of the liner to the interior of inlet and outlet pipes is accomplished. It is possible to have the projection 11*a* of trap 11 and coupling piece 71 secured to the liner prior to the insertion of the liner into the container 1. This helps facilitate a quick insertion and removal of the liner from the container.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. In combination, a container and a removable liner, said combination comprising:

an inlet and an outlet to the container, at least two openings in the liner, and a peripheral edge of one of said openings being removably secured to said inlet and a peripheral edge of the other of said openings being removably secured to said outlet, said at least two openings being smaller than said inlet and said outlet, the peripheral edges of said openings being removably secured to an exterior surface of said inlet and said outlet, the peripheral edges of said openings being stretched around and closely contacting the exterior surfaces of the inlet and the outlet.

2. The combination as claimed in claim 1, wherein the liner includes a plurality of designated potential openings into an interior of the liner.

3. The combination as claimed in claim 1, wherein the liner includes two layers.

4. The combination as claimed in claim 2, wherein the designated potential openings include one of lines of weakness, reduced thickness portions, perforations and projecting truncated cones.

5. The combination as claimed in claim 1, wherein the liner is made of polyethylene.

6. In combination, a container and a removable liner, said combination comprising:

an inlet assembly for receipt of waste water into the container and an outlet assembly for removal of the waste water from the container, at least two openings in the liner to accommodate passage therethrough of at least part of the inlet assembly and the outlet assembly, a peripheral edge of one of said openings being removably secured to said inlet assembly and a peripheral edge of the other of said openings being removably secured to said outlet assembly, and the liner assuming a shape of an interior surface of the container and having sufficient openings to accommodate all inlets to and outlets from the container, said at least two openings being smaller than said inlet assembly and said outlet assembly, the peripheral edges of said openings being removably secured to an exterior surface of part of said inlet assembly and part of said outlet assembly, the peripheral edges of said openings being stretched around and closely contacting the exterior surfaces of the part of the inlet assembly and the part of the outlet assembly.

7. The combination as claimed in claim 6, wherein the peripheral edges of said openings being removably secured to an interior surface of another part of said inlet assembly and another part of said outlet assembly.

8. The combination as claimed in claim 7, wherein a coupling piece extends into the another part of the inlet assembly and the another part of the outlet assembly to removably secure the peripheral edges of said openings to the interior surface of said another part of the inlet assembly and said another part of the outlet assembly.

9. The combination as claimed in claim 6, wherein the liner includes a plurality of designated potential openings into an interior of the liner.

10. The combination as claimed in claim 6, wherein the liner includes two layers.

11. The combination as claimed in claim 8, wherein the coupling pieces include a tapered exterior surface for wedging against the interior surface of the inlet and the outlet to hold the peripheral edges of the openings against the interior surfaces of the inlet and the outlet.

12. The combination as claimed in claim 9, wherein the designated potential openings include one of lines of weakness, reduced thickness portions, perforations and projecting truncated covers.

13. The combination as claimed in claim 6, wherein the liner is made of polyethylene.

* * * * *